United States Patent [19]

Donnelly et al.

[11] 4,167,389

[45] Sep. 11, 1979

[54] OIL BURNER PRIMARY CONTROL FOR INTERRUPTED IGNITION SYSTEM

[75] Inventors: Donald E. Donnelly, Edwardsville, Ill.; John W. Breig, Crestwood, Mo.; Robert L. Gellner, Belleville, Ill.

[73] Assignee: Emerson Electric Co., St. Louis, Mo.

[21] Appl. No.: 847,740

[22] Filed: Nov. 2, 1977

[51] Int. Cl.[2] ..... F23N 5/08

[52] U.S. Cl. ..... 431/79; 307/117

[58] Field of Search ..... 431/27, 70, 71, 72, 431/74, 79, 80; 307/117

[56] References Cited

U.S. PATENT DOCUMENTS

| | | | |
|---|---|---|---|
| 3,732,433 | 5/1973 | Lourigan | 307/117 |
| 3,938,940 | 2/1976 | Bauer | 431/79 |
| 3,947,219 | 3/1976 | Santo | 431/79 |
| 3,947,220 | 3/1976 | Dietz | 431/27 X |

*Primary Examiner*—Edward G. Favors

*Attorney, Agent, or Firm*—Paul A. Becker, Sr.

[57] ABSTRACT

An oil burner primary control in an interrupted ignition system includes therein circuit means responsive to burner flame for initiating energizing of an ignition transformer in the absence of burner flame and for maintaining energizing thereof for a short time period beyond the time at which the burner flame appears.

8 Claims, 3 Drawing Figures

OIL BURNER PRIMARY CONTROL FOR INTERRUPTED IGNITION SYSTEM

This invention relates to burner control systems in which fuel is supplied to a burner for a predetermined short trial ignition period during which an igniter is operated, in which the fuel supply is continued thereafter provided combustion of the fuel occurs within the trial ignition period but is cut off if combustion fails to occur within the trial ignition period, and in which the igniter is rendered inoperative a short time after ignition of the fuel occurs.

In oil burner control systems of the so-called interrupted ignition type, wherein the igniter is operated for only a portion of the burner on cycle, it is generally desirable to keep the igniter energized for a short time period beyond the time at which the combustion flame first appears. This insures that a sustanining flame will be established before the igniter is de-energized.

Conventionally, a thermal delay safety switch is provided in oil burner control systems to provide a timed trial ignition period during which ignition is attempted. If ignition does not occur within the trial ignition period, the safety switch opens, de-energizing the system. If ignition does occur, the safety switch remains closed. One prior art approach to provide an extended ignition time period has been to utilize an additional thermal delay device which is calibrated to a somewhat longer time period than that of the safety switch. The additional thermal delay device de-energizes the igniter a short time after the time period allowed to the safety switch has expired and maintains the igniter in a de-energized condition during the remainder of the burner on cycle. One disadvantage of this arrangement is that the igniter is often kept energized for a longer period than necessary, thus wasting energy, since the additional thermal delay device is dependent on time rather than on the existence of burner flame. Another disdvantage is the inherent inability to immediately attempt re-ignition should the burner flame be extinguished for any reason.

Another prior art approach to provide an extended ignition time period utilizes circuit means responsive to the appearance of the combustion flame as detected by a photoconductive cell. In this approach, the cell instantaneously responds to the appearance of the flame and effects the energizing of circuit means operative for sustaining energizing of the ignition device for a short time. While this approach generally performs satisfactorily, it has a disadvantage in that the circuit means for extending ignition is incorporated in the ignition device rather than in the primary control. This interdependence between the primary control and the ignition device complicates the field replacement of the primary control or the ignition device should one of them become defective or should it be desired to convert a constant ignition system, wherein the igniter is energized during the entire burner on cycle, to an interrupted ignition system. This approach is typified in U.S. Pat. No. 3,938,940.

Therefore, an object of the present invention is to provide an improved oil burner primary control for controlling the operation of an interrupted ignition system having circuit means therein effective to initiate energizing of ignition means and to terminate energizing thereof shortly after the appearance of a combustion flame has been detected.

Another object of the present invention is to provide an improved oil burner primary control wherein a controlled solid state switching device for controlling energizing of ignition means is rendered conductive in the absence of a combustion flame and non-conductive in the presence thereof by circuit means which further includes timing means effective to delay the time at which the controlled solid state switching device becomes non-conductive.

Another object is to provide an improved oil burner primary control for controlling the operation of an interrupted ignition system wherein the ignition means is immediately re-energized upon the occurrence of flame failure.

These and other objects and advantages of the present invention will become apparent from the following description when read in connection with the accompanying drawings.

FIG. 1 of the drawings is a diagrammatic illustration of an oil burner control system constructed in accordance with the present invention.

FIGS. 2 and 3 are fragmentary diagrammatic illustrations of alternate embodiments of the invention.

DESCRIPTION OF THE PREFERRED EMBODIMENT

Figure 1:
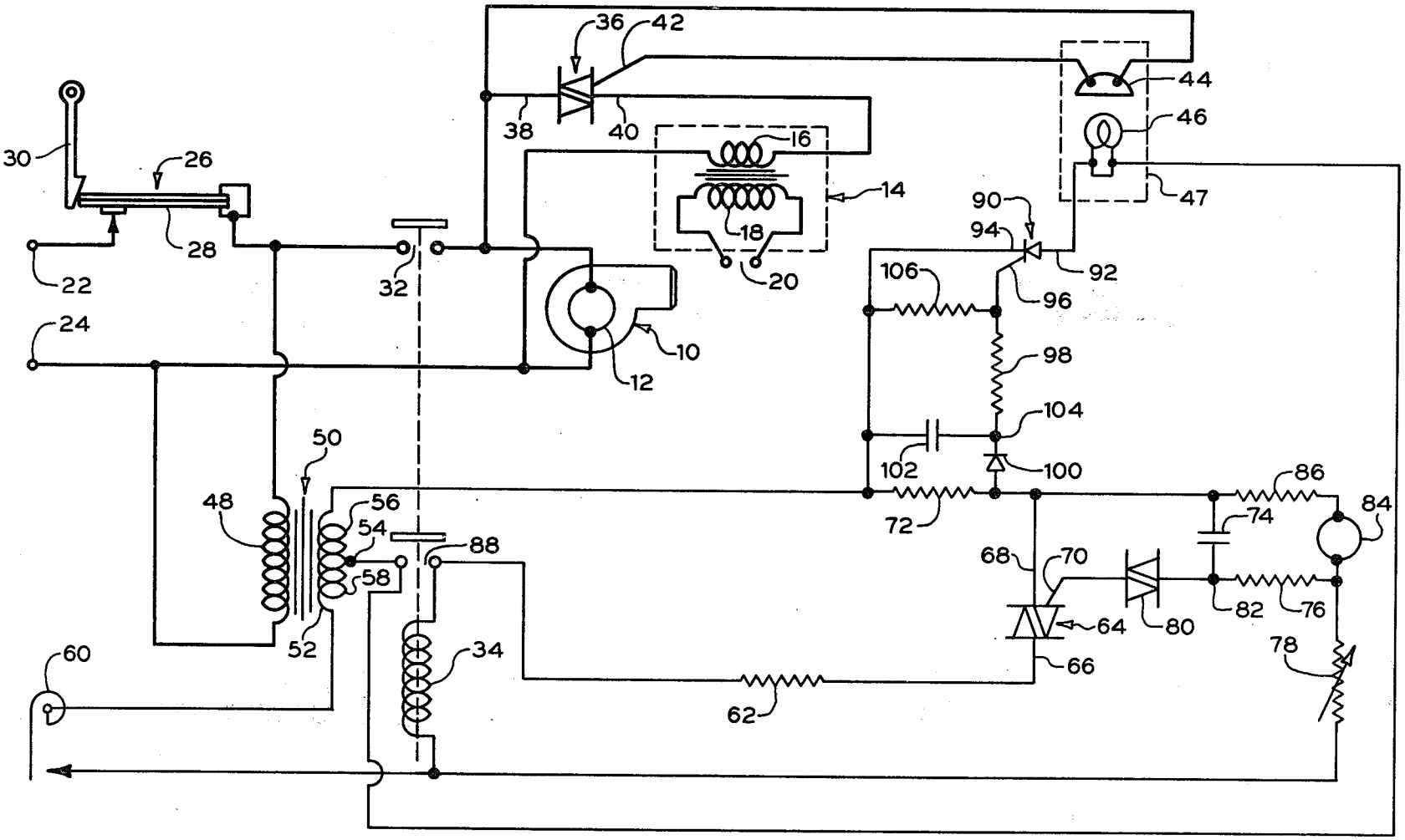

Referring to FIG. 1, the system comprises an oil burner 10 having an electric motor 12 operative to supply fuel and air to burner 10, an ignition transformer 14 having a primary winding 16 and a secondary winding 18, and a pair of spaced spark electrodes 20 disposed adjacent burner 10. The burner motor 12 is connected across a.c. power terminals 22 and 24 in series with a normally closed thermal delay safety switch 26 having a bimetal blade 28 and a pivoted latch 30, and a set of normally open contacts 32 of a motor relay having a winding 34. The ignition transformer primary winding 16 is connected in parallel with burner motor 12 and in series with an ignition switch comprising a triac 36 having a main terminal 38, a main terminal 40, and a gate 42.

A photoconductive cell 44 is connected between the gate 42 and main terminal 38 of triac 36. The cell 44 is mounted adjacent to a filament lamp 46 within a casing 47. Cell 44 has a very high electrical resistance in the ambient drakness within the casing 47. When the filament lamp 46 is sufficiently heated and the motor relay contacts 32 are closed, the cell 44 responds to the light from the filament lamp 46 and becomes sufficiently conductive to permit the gating and conduction of triac 36. It has been determined that the cell 44 and lamp 46 respond in approximately 3 or 4 cycles of the applied a.c. source.

The primary winding 48 of a voltage step-down transformer 50 is connected across a.c. power terminals 22 and 24 through the safety switch 26. The secondary winding 52 of transformer 50 has a center tap at 54 which divides the secondary winding 52 into an upper portion 56 and a lower portion 58.

The motor relay winding 34 is connected across the entire secondary winding 52 in series with a space thermostat 60, a resistance heater 62 associated with safety switch 26, a flame responsive switch in the form of a triac 64 having a main terminal 66, a main terminal 68, and a gate 70, and a resistor 72. A gating circuit for the triac 64 comprises a capacitor 74, a fixed resistor 76, and an adjustable resistor 78 series connected across triac 64, and a diac 80 connected between the gate 70 of triac 64 and a point 82 between capacitor 74 and resistor 76. A photoconductive cell 84, having an extremely high electrical resistance in the absence of light and becoming considerably less resistive when impinged by the light of the burner flame, is connected in series with a fixed resistor 86 across the capacitor 74 and resistor 76. In the absence of burner flame, a large portion of the voltage output of secondary winding 52 appears across the high resistance cell 84 and thus across capacitor 74 and resistor 76. This condition enables capacitor 74 to charge to the firing voltage of diac 80. In the presence of burner flame, the resistance of cell 84 is low so that capacitor 74 is effectively shunted and thus prevented from charging to such firing voltage. In this manner, cell 84 controls the conduction of triac 64.

In addition to controlling contacts 32, motor relay winding 34 also controls another set of normally open contacts 88 which, when closed, provide a hold-in circuit for relay winding 34 through contacts 88, the lower portion 58 of secondary winding 52, and the space thermostat 60. The closing of contacts 88 also completes a circuit across the upper portion 56 of secondary winding 52 through contacts 88, safety switch resistance heater 62, triac 64, and resistor 72.

Connected in series across the upper portion 56 of secondary winding 52 is the filament lamp 46 and an SCR 90 having an anode 92, a cathode 94, and a gate 96. Cathode 94 is connected to one side of resistor 72 and gate 96 is connected through a resistor 98 and a diode 100 to the other side of resistor 72. A capacitor 102 is connected between the cathode 94 and a point 104 between diode 100 and resistor 98. A resistor 106 is connected between the gate 96 and cathode 94 of SCR 90 to shunt any leakage currents and thus prevent SCR 90 from turning on due to leakage current, and to supply the proper gate voltage for SCR 90 when capacitor 102 is sufficiently charged.

OPERATION

Under normal operating conditions, the closing of space thermostat 60 upon a call for burner operation effects the series connection of thermostat 60, resistor 78, photoconductive cell 84, and resistors 86 and 72 across the entire secondary winding 52. Because there is no burner flame, cell 84 is of extremely high electrical resistance and enables capacitor 74 to charge to the firing voltage of diac 80. Conduction of diac 80 enables capacitor 74 to discharge through the gate 70 and main terminal 68 of triac 64, causing triac 64 to become conductive. A circuit is then completed across the entire secondary winding 52 through thermostat 60, relay winding 34, safety switch resistance heater 62, triac 64, and resistor 72, causing the closing of both sets of normally open relay contacts 32 and 88.

The closing of contacts 88 connects the relay winding 34 across the lower portion 58 of secondary winding 52 through thermostat 60 and contacts 88 to provide a hold-in circuit for relay winding 34. This hold-in circuit prevents de-energizing of relay winding 34 when triac 64 subsequently becomes non-conductive.

The closing of relay contacts 88 also connects safety switch resistance heater 62, triac 64, and resistor 72 across the upper portion 56 of secondary winding 52. Safety switch resistance heater 62 begins to heat to provide a timed trial ignition period and SCR 90 is gated on. Each half cycle during which diode 100 conducts, SCR 90 is gated on and capacitor 102 is charged essentially to the voltage across resistor 72. With SCR 90 conducting each half cycle, filament lamp 46 is sufficiently energized through SCR 90 by the upper portion 56 of secondary winding 52.

The closing of relay contacts 32 connects the burner motor 12 across the a.c. power source terminals 22 and 24 through safety switch 26 and relay contacts 32 to initiate the flow of fuel and air to burner 10. The closing of contacts 32 also connects the photoconductive cell 44 across the a.c. power source terminals 22 and 24 through the safety switch 26, contacts 32, the gate 42 and main terminal 40 of triac 36, and primary winding 16 of the ignition transformer 14. When cell 44 is exposed to the light from the energized filament lamp 46, it decreases its resistance, enabling the triac 36 to be gated on. With traic 36 conducting, ignition transformer 14 is energized and sparking occurs at electrodes 20 to ignite the fuel and air mixture. These conditions persist until either combustion of the fuel occurs or until the safety switch 26 opens, terminating the trial period for ignition and de-energizing the entire system.

Under normal operation, combustion occurs well within the timed trial ignition period. When burner flame appears, the resistance of the phtoconductive cell 84 immediately drops sufficiently to shunt capacitor 74 and thus prevent capacitor 74 from charging to the breakdown voltage of diac 80. With disc 80 off, triac 64 is also off so that the safety switch resistance heater 62 is completely de-energized. Also, there is no longer sufficient voltage and current to gate SCR 90 nor to charge capacitor 102. Capacitor 102 discharges through resistor 98 and the gate 96 and cathode 94 of SCR 90. The time constant of the discharge circuit is such that SCR 90 is maintained conductive for approximately one to five seconds beyond the time at which the burner flame is first sensed by the photoconductive cell 84. When SCR 90 is off due to capacitor 102 being discharged, filament lamp 46 is de-energized and photoconductive cell 44 immediately increases its resistance, preventing the gating of triac 36. Thus, approximately one to five seconds after the time at which combustion is first sensed by photoconductive cell 84, the ignition transformer 14 is de-energized. Since relay winding 34 remains energized, contacts 32 remain closed and burner motor 12 remains energized. Under normal operation, there conditions persist until the thermostat 60 opens to de-energize the relay winding 34.

If combustion fails to occur, the bimetal blade 28 of the safety switch 26 will warp upwardly due to heating of the safety switch resistance heater 62 which occurs when triac 64 is conducting, and effect the opening of the safety switch 26. When safety switch 26 opens, the trial ignition period is terminated and the entire system is de-energized. Latch 30 in safety switch 26 prevents automatic re-closing of safety switch 26 as the safety switch resistance heater 26 cools, thus requiring a manual unlatching or resetting of the safety switch 26 to enable attempting another burner operation.

If another normal burner operation the electrical power fails, the relay winding 34 is de-energized, causing the burner motor 12 to be de-energized. Upon resumption of electrical power, the burner motor 12 and ignition transmformer 14 are controlled in the same manner as previously described for a normal operation.

If during normal burner operation the flame is extinguished for any reason, the photoconductive cell 84 immediately responds to the absence of burner flame and causes triac 64 to again become conductive. SCR 90 is again gated on as previously described, enabling the filament lamp 46 and photoconductive cell 44 to be energized and effect the gating of triac 36. It requires less than one second for the above described system to attempt re-ignition after such a flame failure.

Although the coupling arrangement shown in FIG. 1 comprises the photoconductive cell 44 and filment lamp 46, it is to be understood that other quick responding coupling means can be utilized to effect the same performance as described above. Specifically, referring to FIG. 2, a reed switch coil 200 and a filtering capacitor 202 replace lamp 46 and the reed switch contacts 204 replace cell 44. In this arrangement, reed switch coil 200 is energized by the upper portion 56 of transformer secondary winding 52 each half cycle that SCR 90 is conducting, and by capacitor 202 during the other half cycle when SCR 90 is non-conductive. As with the optical coupling arrangement, once flame appears, capacitor 102 maintains SCR 90 conductive for an additional approximately one to five seconds to provide an extended ingition period.

Figure 3:
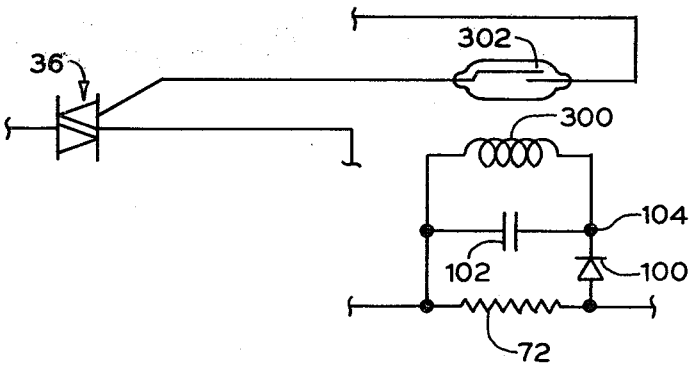

The coupling arrangement can also be accomplished without using SCR 90. Referring to FIG. 3, a reed switch coil 300 having contacts 302 is connected directly across capacitor 102. By constructing the reed switch coil 300 with the required ampere-turns, it can be operated at a very low voltage, negating the need to make a connection of the center tap 54 transformer secondary winding 52. In this arrangement, capacitor 102 provides the dual function of holding in coil 300 when diode 100 is blocking and of providing the sole energy source for maintaining energizing of coil 300 for approximately one to five seconds after flame appears.

Figure 2:
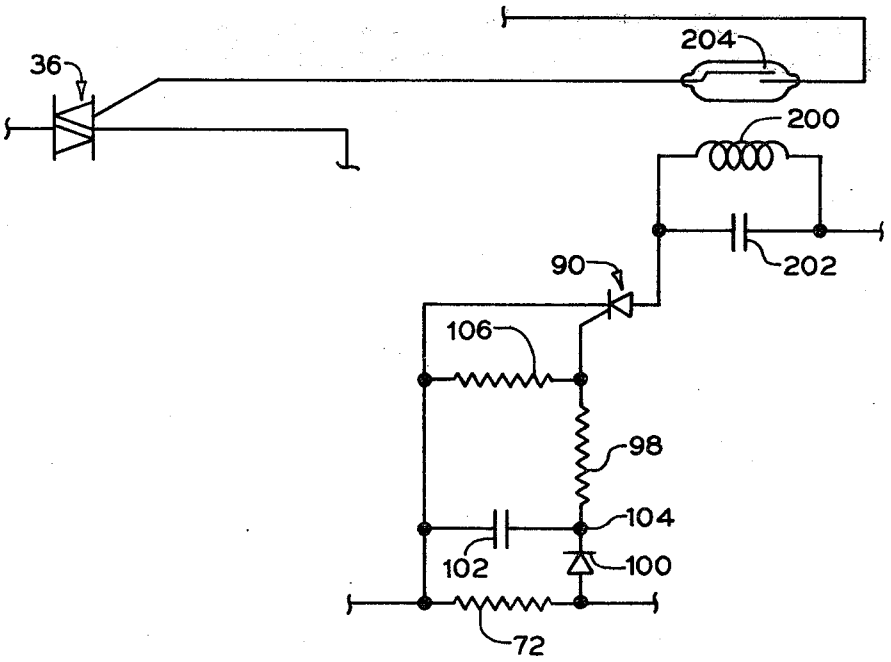

It should also be noted that the resistor 72 could be omitted and the circuit means normally connected across resistor 72 in FIG. 1, 2, and 3 could be connected across safety switch resistance heater 62. It is preferrable from a safety aspect, however, not to connect the circuit means across resistance heater 62 since there is then the possibility that a component failure could effectively short out the resistance heater 62.

The foregoing description is intended to be illustrative and not limiting, the scope of the invention being set forth in the appended claims.

We claim:

1. In a primary control for controlling operation of a fuel burner and an ignition device, an a.c. power source;

a voltage step-down transformer having a primary winding connected across said power source and a secondary winding;

a relay having a winding energized by said secondary winding upon demand for heat and effective for connecting said fuel furner across said power source to initiate flow of fuel;

circuit means including a controlled solid state ignition switch connected in parallel with said fuel burner and effective when said ignition switch is conductive for energizing said ignition device to ignite said fuel;

coupling circuit means for controlling conduction of said ignition switch comprising a first portion connected to said secondary winding and a second portion connected in a gating circuit for said ignition switch; and circuit means including of timing means responsive to a burner flame and adapted to be energized by said secondary winding in the absence of said burner flame for effecting initial energizing of said first portion of said coupling circuit means and for effecting continuing energizing thereof for a predetermined time period beyond the time at which said burner flame appears.

2. The primary control claimed in claim 1 in which said circuit means including timing means responsive to a burner flame and adapted to be energized by said secondary winding in the absence of said burner flame includes a resistor, a diode, and a capacitor, said diode and capacitor being connected in series across said resistor, said capacitor being charged in the absence of said burner flame and discharging in the presence thereof for effecting continuing energizing of said first portion of said coupling circuit means for approximately one to five seconds after said burner flame appears.

3. The primary control claimed in claim 2 further including and SCR connected in series with and controlling energizing of said first portion of said coupling circuit means, a second resistor connected between the gate of said SCR and a point between said diode and said capacitor, said capacitor being connected at its other end to the cathode of said SCR, whereby said SCR is rendered conductive in the absence of said burner flame by said secondary winding and maintained conductive for a short time period in the presence of said burner flame by the discharging of said capacitor through said second resistor.

4. The primary control claimed in claim 3 wherein said first portion of said coupling circuit means comprises a filament lamp and said second portion comprises a photoconductive cell.

5. The primary control claimed in claim 3 wherein said first portion of said coupling circuit means comprises a reed switch coil and a second capacitor connected across said coil, and said second portion comprises contacts actuated by said coil.

6. The primary control claimed in claim 2 in which said first portion of said coupling circuit means comprises a reed switch coil connected across said capacitor and said second portion comprises contacts actuated by said coil, said capacitor providing the sole source of energy for energizing said coil for a short time period in the presence of said burner flame.

7. In a primary control for controlling operation of a fuel burner and an ignition device, a relay having a winding and two sets of normally open contacts;

circuit means for energizing said relay winding including a thermostat, a safety switch resistance heater, a flame responsive switch non-conductive in the presence of a burner flame and rendered conductive in the absence of said burner flame, and a resistor;

circuit means for energizing said fuel burner to initiate flow of fuel including one of said sets of contacts and a safety switch associated with said safety switch resistance heater;

circuit means responsive to energizing of said resistor when said flame responsive switch is conductive for initiating conduction of an ignition switch;

circuit means including said ignition switch connected in parallel with said fuel burner for energizing said ignition device to ignite said fuel;

said circuit means responsive to energizing of said resistor further including timing means effective for maintaining conduction of said ignition switch for a predetermined time period beyond the time at which said flame responsive switch is rendered non-conductive; and circuit means for maintaining energizing of said relay winding when said flame responsive switch is rendered non-conductive including the other of said sets of contacts.

8. In a primary control for controlling operation of a fuel burner and an ignition device, an a.c. power source;

a safety switch;

a voltage step-down transformer having a primary winding connected across said power source through said safety switch and a secondary winding;

a relay having a winding and two sets of normally open contacts;

first circuit means connecting said relay winding across said secondary winding for effecting the closing of said two sets of relay contacts;

said first circuit means including a space thermostat, a safety switch resistance heater, a first triac, and a resistor;

a gating circuit for said first triac including a photoconductive element having considerably higher resistance in the absence of a burner flame than when said burner flame exists, a capacitor connected in parallel with said photoconductive element and charged in the absence of said burner flame, and a voltage breakdown device connected between the gate of said first triac and one side of said capacitor and said photoconductive element effective to cause said first triac to conduct whenever said capacitor is charged sufficiently to cause said voltage breakdown device to conduct;

second circuit means for energizing said fuel burner to initiate flow of fuel including said safety switch and one of said sets of relay contacts;

third circuit means connecting said safety switch resistance heater, said first triac, and said resistor across a first portion of said secondary winding through the other of said sets of relay contacts;

fourth circuit means connecting said relay winding across a second portion of said secondary winding through said other of said sets of relay contacts for maintaining energizing of said relay winding when said first triac is rendered non-conductive due to the presence of said burner flame;

fifth circuit means connected in parallel with said fuel burner for energizing said ignition device to ignite said fuel and including a second triac;

gating circuit means for said second triac;

sixth circuit means connected across said first portion of said secondary winding including a coupling element which, when energized, effects the energizing of said gating circuit means for said second triac, and a series connected controlled solid state switch which, when conducting, enables said coupling element to be energized; and gating circuit means for said controlled solid state switch connected across said resistor including means effective to cause said controlled soild state switch to conduct immediately upon said first triac becoming conductive and including means effective to cause said controlled solid state switch to remain conductive for a short time beyond the time at which said first triac becomes non-conductive.

* * * * *